United States Patent [19]

Cronin

[11] Patent Number: 4,489,668

[45] Date of Patent: Dec. 25, 1984

[54] HULL CONSTRUCTION

[76] Inventor: Thomas B. Cronin, 687 66th St., Oakland, Calif. 94609

[21] Appl. No.: 439,072

[22] Filed: Nov. 3, 1982

[51] Int. Cl.[3] ..... B63B 35/00

[52] U.S. Cl. ..... 114/347; 114/356

[58] Field of Search ..... 114/343, 347, 353, 355–359; 46/1 L

[56] References Cited

U.S. PATENT DOCUMENTS

| | | | |
|---|---|---|---|
| 1,000,786 | 8/1911 | Darrow | 114/356 |
| 1,029,069 | 6/1912 | Lazaron | 114/353 |
| 1,298,942 | 3/1919 | Haskell | 114/347 |
| 1,514,351 | 11/1924 | Strelow | 114/356 |
| 1,679,630 | 8/1928 | Roys | 114/356 |
| 1,790,624 | 1/1931 | Shoup | 114/358 |
| 1,889,368 | 11/1932 | Messenger | 114/356 |
| 2,079,868 | 5/1937 | Patch | 114/358 |
| 2,220,875 | 11/1940 | Barker et al. | 114/358 |
| 2,312,722 | 3/1943 | Lermont | 114/356 |
| 2,684,489 | 7/1954 | Porter | 114/356 |

*Primary Examiner*—Trygve M. Blix
*Assistant Examiner*—Jesûs D. Sotelo

[57] ABSTRACT

An improved method of hull construction from developable material is disclosed for a boat having a hull which consists of triangular panels fitted together. This method produces a rounded hull with a single chine and is easier and less costly to build than existing designs.

18 Claims, 8 Drawing Figures

HULL CONSTRUCTION

This invention relates to boat construction and more particularly to simplified and less costly constructions of canoes and the like.

Canoes as conventionally constructed from plywood have certain disadvantages. For example, several panels of plywood, with intricately curved edges, are joined together in the longitudinal direction forming a hull with several corners or chines. The curved edges of these panels must be cut with precision in order that a mishapen hull does not result. Because the panels are curved, several sheets of plywood must be cut up, resulting in left over material. Furthermore, because several chines are necessary to approximate a smooth hull, there is a great chance for misalignment of the panels. Also the amount of labor increases with the number of chines as well as the weight of the hull.

In accordance with one aspect of the invention, there is provided a boat with a bow section formed of a main panel of generally isosceles triangle configuration, the apex of the main panel being at the bow of the boat hull and the base of the main panel being shaped in a transverse configuration of the hull. A pair of bow panels of generally triangular configuration are attached to the main panel, the short sides of the bow panels being joined together to form the bow of the hull and secured to the apex of the main panel, with each bow panel being longitudinally shaped and being secured to an edge of the main panel.

In accordance with another aspect of the invention, there is provided a method of forming a bow portion of a boat hull that comprises the steps of bending the base of a triangularly shaped main panel transversely to form a transverse section of the hull, bending two other triangularly shaped panels longitudinally to form side portions of the bow section, and joining the three triangularly shaped panels together along the sides of the main panel to form the bow portion.

In a particular embodiment, the boat is of canoe shape and includes a stern section of construction similar to the bow section with a main panel and two stern panels of shape similar to the bow panels of bow section, the bases of the main panels of the bow and stern sections are joined together to form a diamond-shaped panel, one longer side of each bow and stern panel forming a gunwale of its respective section, a bulkhead member that defines a transverse section of the boat is at the junction of the bases of the main panels of the bow and stern sections, and the main panel and bow panels of each section are formed from a single rectangular sheet of developable material —plywood.

The canoe design takes advantage of the potential of plywood construction, and with a method of construction which is cheaper to build as only two sheets of plywood are required with only a small amount of material left over. The resulting canoe is lighter than existing plywood canoes as less joining material, fiberglass for example, is needed because there is only one chine. Further, construction is simplified as one plywood edge is a straight line which is easy to cut and leaves little room for error, and once this piece is bent into shape, the resulting curve defines the curve of the adjoining panel. The amount of labor is further reduced with single chine construction. The design is one that an amateur can build, eliminating the need for kits, patterns, and lofting.

Futher features and advantages of the invention will become seen as the following description of a particular embodiment progresses, in conjunction with the drawings, in which.

Description of Particular Embodiment

Figure 1:
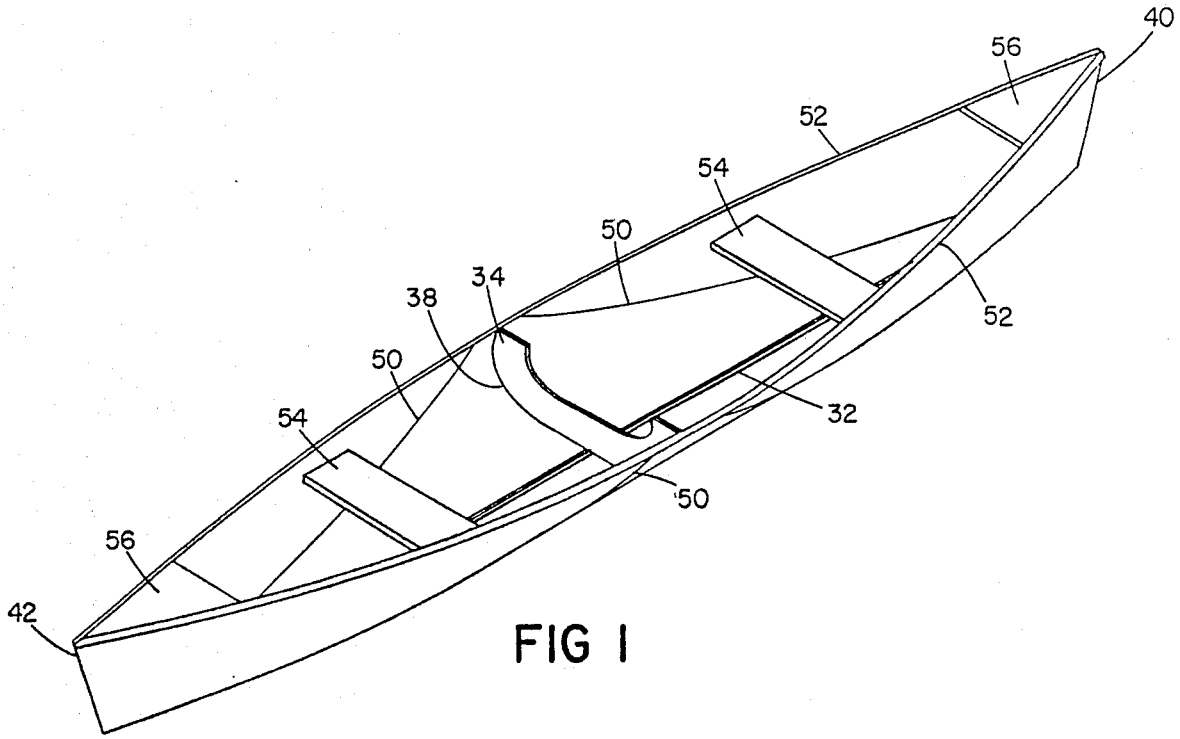
FIG. 1 is an isometric view of a canoe built according to the present invention.
Figure 2:
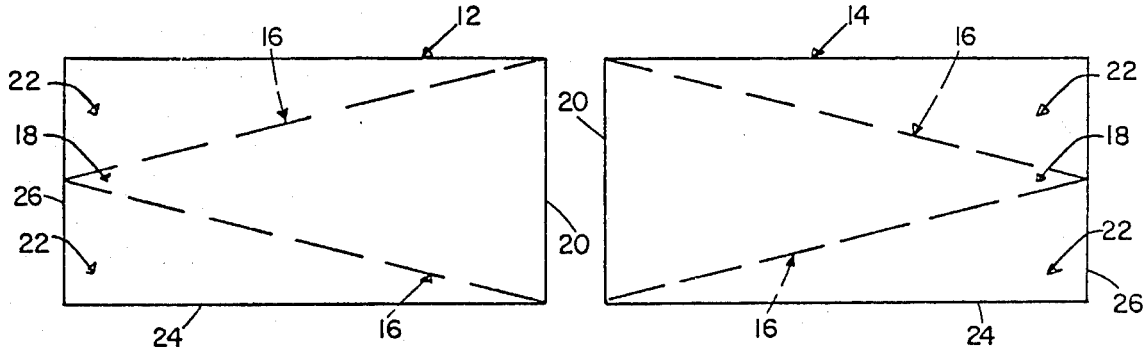
FIG. 2 shows cuts to be made in two sheets of plywood.

Referring to the drawings, the canoe 10 shown in FIG. 1 is constructed from two identical eight foot by four foot sheets 12, 14 of plywood cut as shown in FIG. 2. The two sheets are cut in exactly the same manner, as indicated by the dashed lines 16. These cuts are straight and extend from the center of the shorter side of the plywood panel to the opposite diagonal corner. When the cutting is completed the result is two plywood isosceles triangular panels 18, each with a four foot base 20, and eight foot height and four right triangular panels 22, each with an eight foot side 24 and a two foot side 26.

Figure 3:
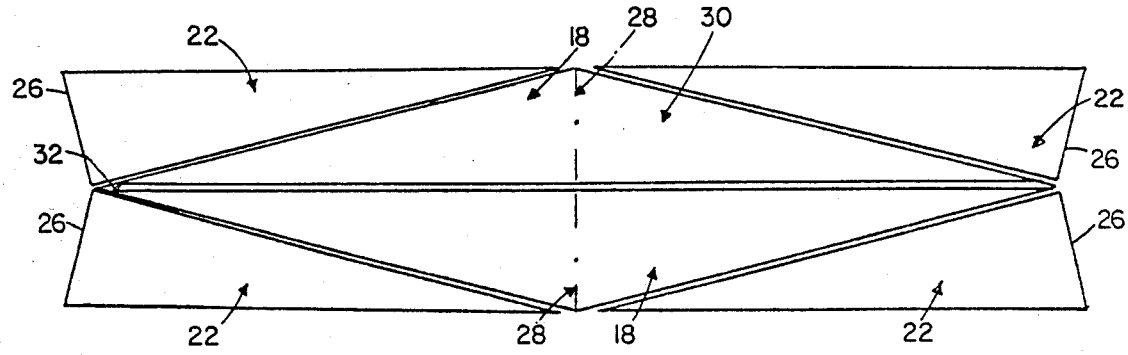
FIG. 3 shows a construction phase where the two large triangular panels are joined and the smaller triangular pieces are flipped over.

FIG. 3 shows the above mentioned panels 18, 22 rearranged. The two isosceles triangle panels 18 have been joined together with a scarf or bevel joint 28 to form a base panel 30 of diamond configuration. The bonding agent used may be a mastic, contact cement for example, or some other flexible adhesive so that the scarf will not prevent transverse bending of panel 30, comprised of two pieces of plywood, at a later stage. The keel 32 is shown fastened to the centerline of panel 30 while still flat. Panels 22 have been rotated 180 degrees or more simply flipped over. Panels 22 can now be hinged against panel 30 and rotated 90 degrees up so that their sides 26 form the bow and stern.

Figure 4:
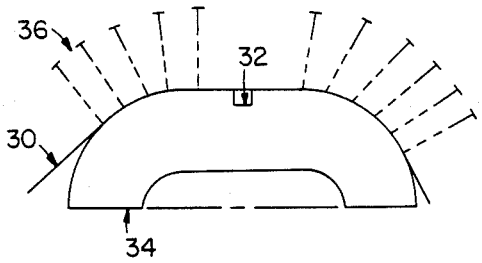
FIG. 4 shows the midship section and how the diamond shaped plywood panel is bent over a center bulkhead.

Before panels 22 can be flipped up, panel 30 must be bent transversely as indicated in FIG. 4. Panel 30 is bent transversely at the scarf 28 around a bulkhead 34. The perimeter of this bulkhead must be four feet in order to match the plywood dimensions. Attaining a four foot perimeter can be accomplished with an infinite family of bulkhead shapes. One shape in particular could be two quarter circles with a 12 inch radius connected by a straight tangent line 10.3 inches long. This bulkhead example will not over stress $\frac{1}{8}$ inch plywood or equivalent. The bulkhead 34 should be of sufficient thickness to allow screws 36, fitted with large washers, to be screwed into the bulkhead edge. Panel 30 is clamped between the washers and the bulkhead 34 which bends the panel to the curvature of the bulkhead. The screws 36 should be spaced transversely about two inches apart. Staples or some other fasteners could be used in lieu of screws. The keel 32 is shown extending longitudinally through the bulkhead on the inside of the hull. The placement of the keel on the inside is to prevent the canoe from getting caught on the river bottom and capsized as it is swept sideways. However the keel could also be fastened to the outside of the hull without affecting the design. The purpose of the keel is to provide longitudinal strength and local stiffness. Once panel 30 is bent around the bulkhead 34, a large adhesive fillet 38 (FIG. 1) can be applied to the inside of the hull permanently joining the plywood to the bulkhead and then the screws can be withdrawn. A cleat could also be used instead of an adhesive fillet.

Figure 5:
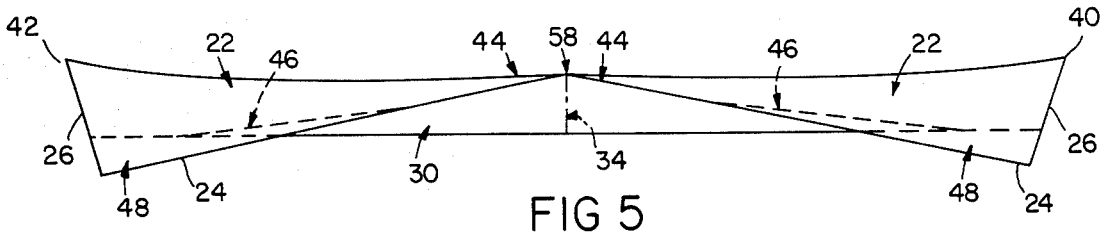
FIG. 5 is a profile which shows the plywood panels in the process of being fitted together.
Figure 6:
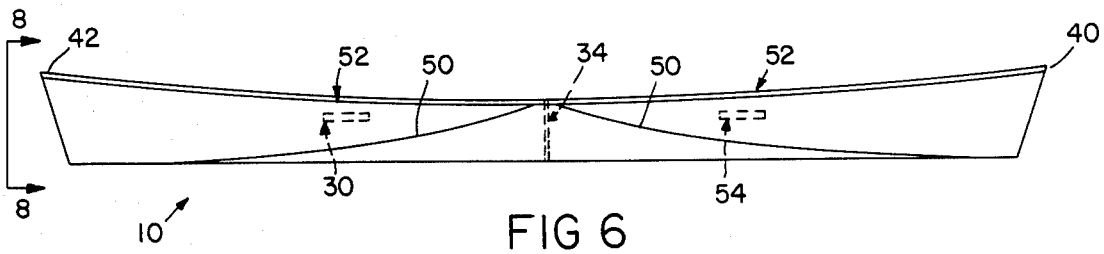
FIG. 6 is a side elevational view, or profile, of the canoe shown in FIG. 1.

FIG. 5 shows the shape panel 30 has now assumed in profile. Edges 26 of panels 22 are now secured together at what are to become the bow 40 and stern 42. The tip ends 44 of each panel 22 closest to the bulkhead 34 are also wired to panel 30, providing a degree of longitudinal bending of each panel 22. Panels 22 are dropped down so that edges 24 become tangent to the initial curvature of panel 30. A pencil run along each panel 22 on the inside of the hull will trace out the cut 46 to be made in panels 22. After this cut and the area 48 is removed from all of panels 22 they are attached to panel 30 by the stitch and glue method. Small holes are drilled about every three inches in both panels 22 and 30 close to the chine 50 (FIG. 6) and then the panels are stitched together with a combination of copper wire and nylon thread. Once this step is accomplished, gunwales 52 shown in FIG. 6 are fastened to the top edges of panels 22, which remains uncut and therefore straight but appears curved when bent longitudinally to mate with panel 30. Fiberglass tape is now applied to the inside of the hull at the chine 50, bow 40 and stern 42 permanently joining all the panels together. The wire ties and nylon thread is withdrawn and the outside of the chine, bow and stern is covered with fiberglass tape.

Figure 7:
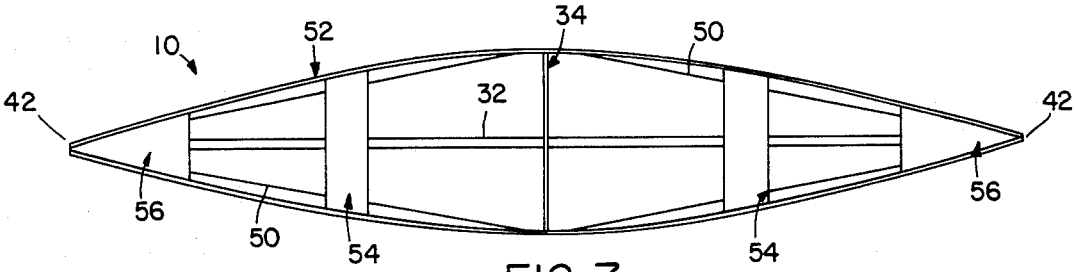
FIG. 7 is a top plan view thereof.
Figure 8:
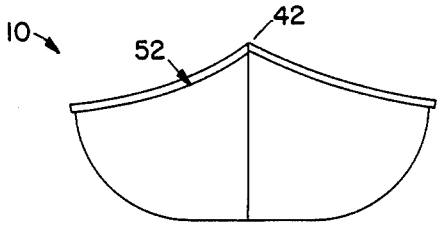
FIG. 8 is an enlarged end view on line 8—8 of FIG. 6.

The construction of the hull is now complete and seats 54 and end decks 56 can be installed as shown in FIGS. 1 and 7. The corner 58 at the scarf is slightly higher than the edge of panel 30 at the gunwale 52 as shown in FIG. 5. This is because the bottom edges of panels 22 are shorter than the edges of panel 30 which is slightly over eight feet. The top of the bulkhead 34 and the corners 58 of panel 30 can be trimmed off.

The canoe can be paddled by two persons one sitting in the forward seat and another in the aft seat. A seat can also be fitted amidships and the canoe can then be paddled by one person or rowed with the installation of oarlocks.

While a particular embodiment of the invention has been shown and described, various modifications will be apparent to those skilled in the art. For example, the shape of the bulkhead can be varied producing fine or full hull forms. Also a second identical bulkhead to the one amidships could be placed at the stern with a single uncut sheet of plywood between producing a hull with a transom. The boat could also be lengthened by adding on additional sheets of plywood or by using plywood with dimensions other than eight by four feet. Other developable material could be used instead of plywood. Some other process besides stitch and glue could be used and the sheets could be joined in some other manner than a scarf. The cuts made in the plywood need not be straight. The hull could be decked over completely and joined with other hulls to form a multi-hull. Accordingly, the scope of the invention is not intended to be limited to the disclosed embodiment or to details thereof and departures may be made therefrom within the spirit and scope of the invention.

What is claimed is:

1. A boat comprising a hull with a bow section and a stern section, said bow section being formed of a main panel of generally isosceles triangle configuration, the apex of said main panel being at the bow of said hull and the base of said main panel being shaped in smoothly curved transverse configuration, and a pair of bow panels of generally triangular configuration, the short sides of said bow panels being joined together to form the bow of said hull and secured to the apex of said main panel, and a longer side of each said bow panel being longitudinally shaped and being secured to an edge of said main panel.

2. The boat of claim 1 wherein one longer side of each said bow panel forms a gunwale of said bow section.

3. The boat of claim 1 wherein said main panel and bow panels are formed from a single rectangular sheet of developable material.

4. The boat of claim 3 wherein said sheet is of plywood.

5. The boat of claim 1 wherein said stern section is of construction similar to said bow section and includes a main panel and two stern panels of shape similar to the bow panels of said bow section.

6. The boat of claim 5 wherein the bases of said main panels of said bow and stern sections are joined together to form a diamond-shaped panel.

7. The boat of claim 5 and further including a bulkhead member at the junction of the bases of said main panels of said bow and stern sections, said bulkhead member defining a transverse section of said boat.

8. The boat of claim 1 wherein said main panel and bow panels are formed from a single rectangular sheet of plywood, and one longer side of each said bow panel forms a gunwale of said bow section.

9. The boat of claim 8 wherein said stern section is of construction similar to said bow section and includes a main panel and two stern panels of shape similar to the bow panels of said bow section, the bases of said main panels of said bow and stern sections being joined together to form a diamond-shaped panel, and a bulkhead member at the junction of the bases of said main panels of said bow and stern sections, said bulkhead member defining a transverse section of said boat.

10. The boat of claim 1 wherein the base of said main panel extends from gunwale to gunwale.

11. The boat of claim 1 wherein the chine between each bow panel and said main panel extends along a curved path from the bottom of said bow upwardly towards the gunwal adjacent the base of said main panel.

12. The boat of claim 1 wherein said boat is a canoe, and said smoothly curved transverse configuration of the base of said main panel extends from gunwale to gunwale.

13. A method of forming a bow portion of a boat hull comprising the steps of:

(a) bending the base of a triangularly shaped main panel transversely to form a smoothly curved transverse section of said hull, bending two other triangularly shaped side panels longitudinally to form smoothly curved side portions of said bow section, and joining said three smoothly curved triangularly shaped panels together along the sides of said main panel to form between an edge of said main panel and an edge of a side panel on either side of said bow a chine portion that extends from the tip of said main panel at the bottom of the bow along a curved path to the gunwale of said bow portion adjacent the base of said main panel.

14. The method of claim 13 and further including the step of forming said three triangularly shaped panels from a single rectangular sheet of developable material.

15. The method of claim 14 wherein said main panel is of generally isoceles triangular configuration and one longer side of each said side panel forms a gunwale of said bow section.

16. The method of claim 13 and further including the step of forming a stern section of construction similar to said bow section, said stern section including a main panel and two stern panels of shape similar to the bow panels of said bow section.

17. The method of claim 16 and further including the step of joining the bases of said main panels of said bow and stern sections together to form a diamond-shaped panel.

18. The method of claim 13 wherein each said side panel has one short side and two longer sides, and further including the step of joining the said short sides of said side panels together to form the bow of said hull.

* * * * *